US006942560B2

(12) United States Patent
Hofmann et al.

(10) Patent No.: US 6,942,560 B2
(45) Date of Patent: Sep. 13, 2005

(54) ATTACHMENT AND RAPID-CHUCKING SYSTEM, COMPRISING A ROTATABLY DRIVEN, DISC-SHAPED HUB

(75) Inventors: Albrecht Hofmann, Steinenbronn (DE); Harald Krondorfer, Ludwigsburg (DE); Markus Heckmann, Leinfelden-Echterdingen (DE); Thomas Schomisch, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/495,023

(22) PCT Filed: Feb. 19, 2003

(86) PCT No.: PCT/DE03/00512

§ 371 (c)(1),
(2), (4) Date: May 10, 2004

(87) PCT Pub. No.: WO03/095147

PCT Pub. Date: Nov. 20, 2003

(65) Prior Publication Data

US 2004/0266325 A1 Dec. 30, 2004

(30) Foreign Application Priority Data

Apr. 24, 2002 (DE) ..... 102 18 196

(51) Int. Cl.[7] ..... B24D 13/20
(52) U.S. Cl. ..... 451/359; 451/540

(58) Field of Search ..... 451/342, 344, 451/359, 509, 508, 540, 548

(56) References Cited

U.S. PATENT DOCUMENTS

| | | | | | |
|---|---|---|---|---|---|
| 2,747,343 | A | * | 5/1956 | Gellert | 451/342 |
| 3,623,281 | A | * | 11/1971 | Moffat | 451/509 |
| 6,110,027 | A | * | 8/2000 | Muller | 451/359 |
| 6,110,028 | A | * | 8/2000 | Chung | 451/359 |
| 6,309,288 | B1 | * | 10/2001 | Chung | 451/359 |
| 6,786,811 | B2 | * | 9/2004 | Krondorfer et al. | 451/342 |
| 6,814,655 | B2 | * | 11/2004 | Hofmann et al. | 451/342 |
| 2003/0176153 | A1 | * | 9/2003 | Krondorfer et al. | 451/359 |

FOREIGN PATENT DOCUMENTS

| | | |
|---|---|---|
| DE | 201 08 986 U | 8/2001 |
| DE | 100 17 458 A | 10/2001 |
| WO | 01 08850 A | 2/2001 |

* cited by examiner

*Primary Examiner*—Jacob K. Ackun, Jr.
(74) *Attorney, Agent, or Firm*—Michael J. Striker

(57) ABSTRACT

The invention is based on an insert tool with a rotationally driveable disk-shaped hub and an abrasive disposed in particular in a radially outer region, in particular of the kind used for a cut-off wheel, a grinding disk, a rough grinding disk, a cutting disk, or an abrasive paper. The invention proposes that the hub (10) have at least one mount (16, 18, 20), which is disposed off-center, extends in the axial direction (14), and is intended for a bolt that constitutes a functional element of a quick-action clamping system.

9 Claims, 2 Drawing Sheets

ATTACHMENT AND RAPID-CHUCKING SYSTEM, COMPRISING A ROTATABLY DRIVEN, DISC-SHAPED HUB

BACKGROUND OF THE INVENTION

The invention is base on an insert tool and a quick-action clamping system with a rotationally driveable disk-shaped hub.

Disk-shaped insert tools, e.g. grinding or cut-off wheels for angle grinders, are usually comprised of a bonded abrasive and have a circular socket in the center via which the insert tool can be attached to an angle grinder spindle with a retaining nut in a nonpositive, frictionally engaging fashion in the circumference direction and in a positively engaging fashion in the axial direction. There are known insert tools that have a reinforcing plate made of sheet metal in the vicinity of the socket as well as those that do not have a reinforcing plate.

SUMMARY OF THE INVENTION

The invention is based on an insert tool with a rotationally driveable disk-shaped hub and with an abrasive disposed particularly in a radially outer region, in particular of the kind used in a cut-off wheel, a grinding disk, a rough grinding disk, a cutting disk, an abrasive paper, etc.

The invention proposes that the hub have at least one axially extending socket disposed off-center for a functional element of a quick-action clamping system, which element is embodied in the form of a bolt; the shape of the bolt can have a cross section deemed appropriate by one skilled in the art, for example a cross section that is circular, elliptical, triangular, square, polygonal, etc. The functional element can be advantageously prevented from inadvertently colliding with a work piece to be machined by embodying the axial span of the socket as preferably greater than a distance that the functional element or bolt protrudes from the hub. Changing the hub whenever the insert tool is replaced makes it possible to assure a constant protection function. The socket also constitutes a flat support for the functional element, which makes it possible to advantageously prevent the hub from cutting into the functional element. A wear on the functional element due to the influence of abrasive dusts such as corundum dust can be reduced because the socket formed onto the hub covers the functional element to a large extent. The hub can be safely detached from the functional element at any time. A premature wear on the functional element due to its being cut into can be prevented and service intervals can be extended. The axially extending socket can also advantageously prevent the insert tool from being mounted into a tool socket in a laterally reversed orientation. Furthermore, an operator can immediately recognize a correct mounting side by looking at the socket, which is important in insert tools that are rotation direction specific.

The socket can be of one piece with the hub or can be a part separate from it. If the socket and the hub are embodied as separate parts, then different materials can be used, e.g. metal for the hub and plastic for the socket, etc. However, it is particularly advantageous if the socket is of one piece with the hub. This permits the production of a particularly stable socket with an especially advantageous protection of the functional element from mechanical damage. The socket here can be formed onto the hub in a particularly simple, inexpensive manner by means of a deep-drawing process.

If the socket has a closed side wall, this permits a particularly rigid embodiment with an advantageous protection of the functional element and permits the socket to transmit powerful moments. However, it is also conceivable for the side wall to be embodied as slotted. A slotted side wall advantageously permits compensation for tolerances by means of elastic deformations and permits a simple prevention of play between the socket and the functional element. In addition, dirt that collects in the socket can be removed through the slot in a structurally simple manner when the functional element is inserted.

In another embodiment, the invention proposes that the socket have a round cross-sectional area. The functional element that engages in the socket can be advantageously embodied with a round cross-sectional area. The functional element can be inexpensively produced and can be reliably prevented from tilting in the socket.

The invention also proposes that the socket have at least one through opening in its end oriented in the axial direction. When the functional element is inserted into the socket, dirt and abrasive dust contained in the socket can be easily be pushed through the through opening by the functional element and then conveyed out of the socket.

If the socket is disposed in a recessed region of the hub, then the shape of the hub can provide a further protection of the functional element. The socket is recessed in relation to a disk plane, which can advantageously reduce the danger of a possible collision with a work piece.

If the socket protrudes in the axial direction beyond a hold-down element and in particular, if the socket is disposed in front of the hold-down element in a direction counter to a rotation direction, then this permits the hold-down element to be protected from an inadvertent collision with a work piece in an advantageous and structurally simple manner.

BRIEF DESCRIPTIONS OF THE DRAWINGS

Other advantages ensue from the following description of the drawings. The drawings show an exemplary embodiment of the invention. The drawings, the specification, and the claims contain numerous features in combination. One skilled in the art will also consider the features individually and will unite them in other meaningful combinations.

DETAILED DESCRIPTION OF THE PREFERRED EMBODIMENTS

Figure 1:
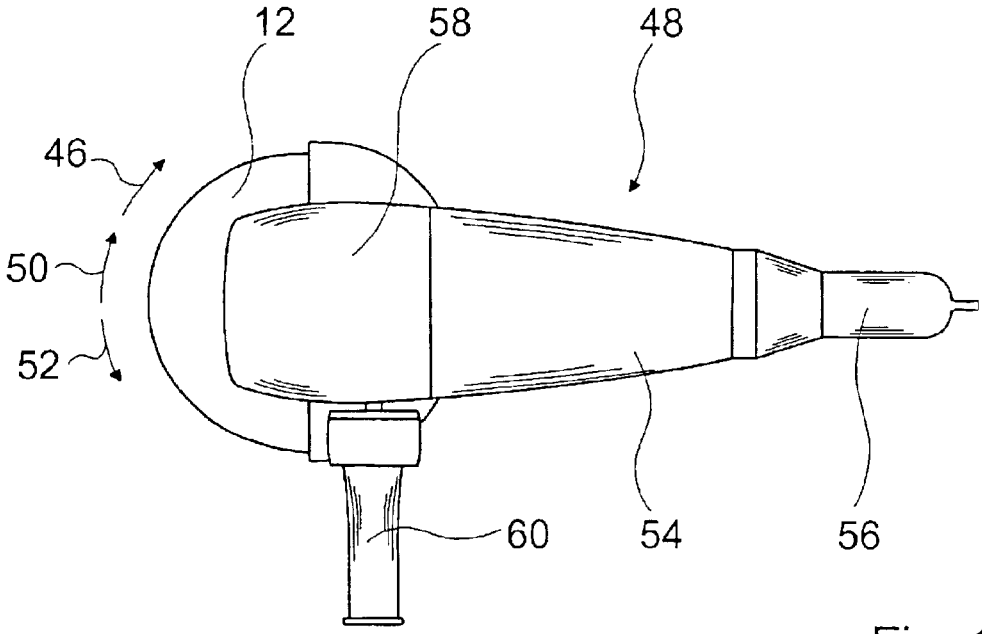
FIG. 1 is a schematic top view of an angle grinder.

FIG. 1 is a top view of an angle grinder 48, with an electric motor, not shown in detail, that is mounted in a housing 54. The angle grinder 48 can be guided by means of a first handle 56 extending in the longitudinal direction, which is integrated into the housing 54 at the end oriented away from the insert tool, and by means of a second handle 60 extending lateral to the longitudinal direction, which is fastened to a linkage housing 48 in the region of the insert tool.

Figure 2:
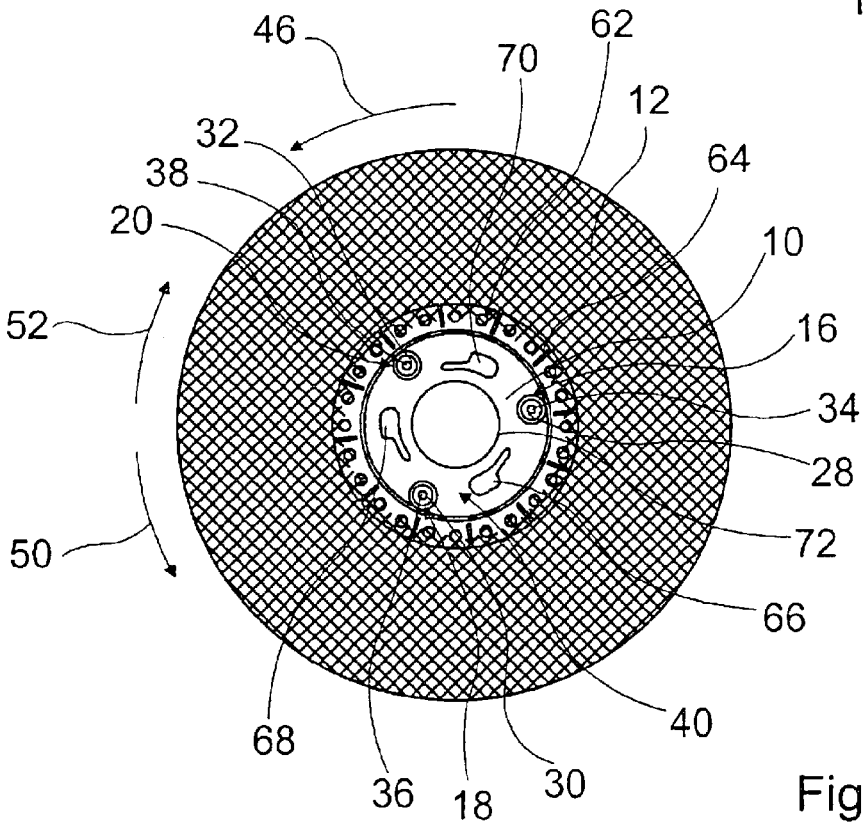
FIG. 2 shows an insert tool according to the invention.

FIG. 2 shows the insert tool from FIG. 1 when not installed. The insert tool has a rotationally driveable disk-shaped hub 10 made of sheet steel, whose radially outer region has an abrasive 12 attached to it, which constitutes a grinding disk. The abrasive 12 is essentially comprised of fiberglass mats, abrasive particles, and a bonding agent, which are pressed together to form a solid disk, the bonding agent having been hardened in a heating process.

Figure 3:
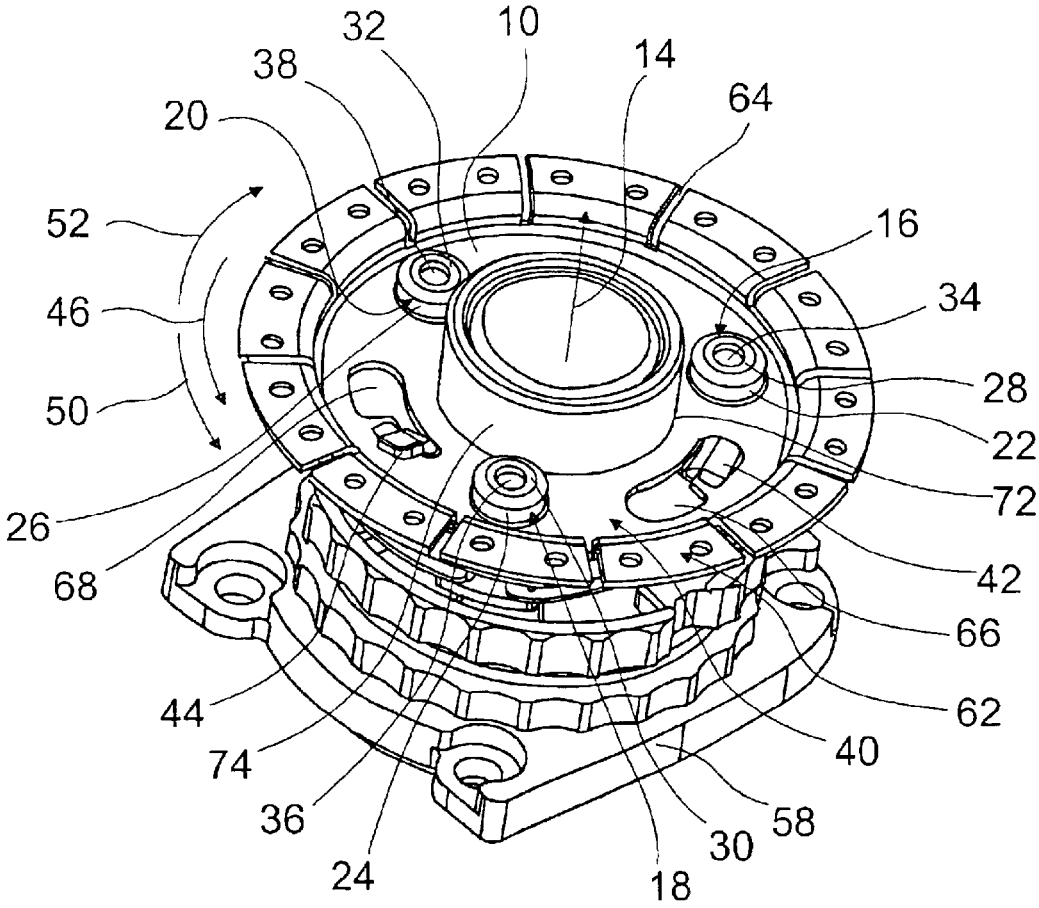
FIG. 3 is an enlarged depiction of a hub without an abrasive, which hub is mounted in the angle grinder.

The hub 10 has an inner region 40 and an outer region 62, the inner region 40 being recessed in relation to the outer region 62 (FIG. 3). In its outer region 62, the hub 10 has slot-shaped spaces 64 that are open at their radially outer ends. The spaces 64 have a uniform width and extend radially inward to the inner region 40. The recessed inner region 40 has recesses 66, 68, 70 let into it for the attachment of the insert tool by means of a quick-action clamping system. The recesses 66, 68, 70 are disposed distributed uniformly in the circumference direction 50, 52 and, oriented counter to a rotation direction 46, have a narrow, oblong region that is adjoined by a wider, oval region.

When the insert tool is mounted on the angle grinder 48, three hold-down elements 42, 44, only two of which are shown, reach in the axial direction 14 through the recesses 66, 68, 70 and affix the hub to a tool socket in the axial direction. In the middle region of the hub 10, there is a circular opening 72 for centering the insert tool on a collar 74 of the tool socket of the angle grinder 48.

Between the recesses 66, 68, 70, the hub 10 has three sockets 16, 18, 20, which are disposed off-center, extend in the axial direction, and are distributed uniformly in the circumference direction 50, 52. Functional elements of the quick-action clamping system, which are comprised of bolts and are not shown in detail, engage in a positively engaging fashion in the sockets 16, 18, 20. The bolts, which are each supported so that they can move in opposition to a respective spring element, can be used to operatively connect the insert tool to the quick-action clamping system; in an operating position of the insert tool, these bolts engage in detent fashion in the sockets 16, 18, 20 and fix the insert tool in a positively engaging fashion in the circumference direction 50, 52.

The sockets 16, 18, 20, which have a round cross section, are of one piece with the hub 10 and each have a closed side wall 22, 24, 26. The sockets 16, 18, 20 are formed onto the hub 10 in a deep-drawing process.

On their ends 28, 30, 32 oriented in the axial direction 14, the sockets 16, 18, 20 each have a respective through opening 34, 36, 38. The sockets 16, 18, 20, which are disposed in front of three hold-down elements 42, 44 in the direction counter to the rotation direction 46, protrude beyond the three hold-down elements 42, 44 in the axial direction 14. When being driven in the rotation direction 46, the three hold-down elements 42, 44 are consequently each disposed in the slipstream of a respective bowl-shaped socket 16, 18, 20 and are protected by them.

Reference Numerals

| | |
|---|---|
| 10 | hub |
| 12 | abrasive |
| 14 | axial direction |
| 16 | mount |
| 18 | mount |
| 20 | mount |
| 22 | side wall |
| 24 | side wall |
| 26 | side wall |
| 28 | end |
| 30 | end |
| 32 | end |
| 34 | through opening |

-continued

| | |
|---|---|
| 36 | through opening |
| 38 | through opening |
| 40 | region |
| 42 | hold-down element |
| 44 | hold-down element |
| 46 | rotation direction |
| 48 | angle grinder |
| 50 | circumference direction |
| 52 | circumference direction |
| 54 | housing |
| 56 | handle |
| 58 | linkage housing |
| 60 | handle |
| 62 | region |
| 64 | recess |
| 66 | recess |
| 68 | recess |
| 70 | recess |
| 72 | opening |
| 74 | collar |

What is claimed is:

1. An insert tool with a rotationally driveable, disk-shaped hub (10) and with an abrasive (12) disposed in a radially outer region, wherein the hub (10) has at least one socket (16, 18, 20), which is disposed off-center, extends in the axial direction (14), and is intended for a bolt that constitutes a functional element of a quick-action clamping system, and wherein an axial span of said socket is greater than a distance that said bolt protrudes from the hub.

2. The insert tool according to claim 1, wherein the socket (16, 18, 20) is of one piece with the hub (10).

3. The insert tool according to claim 1, wherein the socket (16, 18, 20) has a closed side wall (22, 24, 26).

4. The insert tool according to claim 1, wherein the socket (16, 18, 20) has a round cross-sectional area.

5. The insert tool according to claim 1, wherein the socket (16, 18, 20) has at least one through opening (34, 36, 38) on an end (28, 30, 32) oriented in the axial direction (14).

6. The insert tool according to claim 1, wherein the socket (16, 18, 20) is disposed in a recessed region (40) of the hub (10).

7. The insert tool according to claim 1, wherein the socket (16, 18, 20) protrudes beyond a hold-down element (42, 44) in the axial direction (14).

8. The insert tool according to claim 7, wherein the socket (16, 18, 20) is disposed in front of the hold-down element (42, 44) in a direction counter to a rotation direction (46).

9. A quick-action clamping system, comprising an insert tool according to claim 1 and with a quick-action clamping mechanism, wherein said system operationally connects the insert tool to a drive shaft, wherein the insert tool is operationally connected to the quick-action clamping system by means of at least one bolt-shaped detent engagement element, wherein said detent engagement element is supported so that it can move in opposition to a spring element and, in an operating position of the insert tool, engages in detent fashion in the socket and fixes the insert tool in a positively engaging fashion in a circumference direction.

* * * * *